US010173126B2

(12) United States Patent
Brouillard et al.

(10) Patent No.: US 10,173,126 B2
(45) Date of Patent: Jan. 8, 2019

(54) LOTTERY GAME SYSTEM, PRODUCT AND METHOD

(71) Applicant: IGT GLOBAL SOLUTIONS CORPORATION, Providence, RI (US)

(72) Inventors: David Brouillard, Candiac (CA); Lauren Mega, Rumford, RI (US)

(73) Assignee: IGT Global Solutions Corporation, Providence, RI (US)

( * ) Notice: Subject to any disclaimer, the term of this patent is extended or adjusted under 35 U.S.C. 154(b) by 163 days.

(21) Appl. No.: 15/125,226

(22) PCT Filed: Feb. 25, 2016

(86) PCT No.: PCT/US2016/019474

§ 371 (c)(1),
(2) Date: Sep. 12, 2016

(87) PCT Pub. No.: WO2016/138210

PCT Pub. Date: Sep. 1, 2016

(65) Prior Publication Data

US 2018/0169513 A1 Jun. 21, 2018

Related U.S. Application Data

(60) Provisional application No. 62/121,826, filed on Feb. 27, 2015.

(51) Int. Cl.
*G07F 17/32* (2006.01)
*A63F 3/06* (2006.01)
(Continued)

(52) U.S. Cl.
CPC ..... *A63F 3/0605* (2013.01); *A63F 3/0665* (2013.01); *G07C 15/005* (2013.01);
(Continued)

(58) Field of Classification Search
CPC ..... A63F 3/0605; A63F 3/065
See application file for complete search history.

(56) References Cited

U.S. PATENT DOCUMENTS 7,431,295 B2 10/2008 Scrymgeour et al.
8,366,153 B2 2/2013 Martineck, Sr.
(Continued)

OTHER PUBLICATIONS

International Search Report and Written Opinion (ISR/WO), PCT/US16/19474, US International Search Authority, dated May 3, 2016.

*Primary Examiner* — Omkar Deodhar
(74) *Attorney, Agent, or Firm* — Williams Mullen; Thomas F. Bergert

(57) ABSTRACT

A lottery game system, product and method employs multiple connected crossword grids, where players can employ a set of player letters to form words within the crossword grids. In various embodiments of the present invention, a total number of potentially winnable prizes is provided, with a first subset of the potentially winnable prizes associated with the first crossword grid, a second subset of the potentially winnable prizes associated with the second crossword grid, and a third subset of the potentially winnable prizes associated with the first and second crossword grids together. In various embodiments, at least one game play element is not in either the first or second grids and is not player indicia.

20 Claims, 4 Drawing Sheets

(51) Int. Cl.
*G07C 15/00* (2006.01)
*A63F 3/04* (2006.01)

(52) U.S. Cl.
CPC ..... *G07F 17/32* (2013.01); *G07F 17/329* (2013.01); *G07F 17/3286* (2013.01); *A63F 3/0655* (2013.01); *A63F 2003/0428* (2013.01)

(56) References Cited

U.S. PATENT DOCUMENTS

| | | | |
|---|---|---|---|
| 8,444,469 | B2 | 5/2013 | Stanek |
| 8,460,081 | B2 | 6/2013 | Meyer |
| 2007/0063432 | A1 | 3/2007 | Trudel et al. |

LOTTERY GAME SYSTEM, PRODUCT AND METHOD

TECHNICAL FIELD

The present invention relates to lottery game systems and methods, and more particularly to a lottery game system facilitating the operation of a game of chance while providing multiple win opportunities.

BACKGROUND ART

Lottery games and instant win tickets are known to provide one or more potentially winnable prizes in the event a player makes a match with a winning number, symbol or series of numbers or symbols. For example, a Bingo lottery ticket is provided with a grid with individual indicia in each distinct area of the grid. The Bingo lottery ticket further provides a set of "called" numbers. The player can mark the grid indicia corresponding to the called numbers, and if the player matches all of the indicia in a pre-established pattern, such as along a row, column or diagonal line, then the player wins. As another example, a crossword-type game can be provided on a ticket, where a player receives one or more "player" letters that can be uncovered on a crossword grid in order to form words. In such crossword-type games, prizes can be awarded based on the number of words formed in the grid. In some embodiments, the grid is populated with a set of words with a scratch-off coating atop each letter in the words. The scratch-off coating can be transparent, translucent or potentially an array of opaque elements that permit the user to see the underlying indicia such that, when the scratch-off layer is removed, the player can visually tell the difference between scratched-off areas and areas that have not been scratched off. Such a screen of opaque elements is described, for example, in U.S. Patent Application Publication No. 2010/0045026 to Napolitano et al., the disclosure of which is incorporated by reference herein in its entirety.

Lottery game players are often motivated to play games that appear to offer a greater number of potential wins. In many ticket games, for example, players are given one or maybe two potential chances to win at a matching game. Even in a crossword-type game with a seven-by-seven grid and eighteen player letters, a low number of potential ways to win can be a limiting factor in player appeal and sales. There can further be a natural space limit on lottery tickets that hinders the ability to represent too many features or game elements.

Therefore, there is a need to provide a lottery game system, product and method addressing the above and related problems.

DISCLOSURE OF INVENTION

According to various embodiments, the present invention provides a game system, product and method employing a crossword-like design, where multiple crossword grids are connected, and where players can employ a set of player letters to form words within the crossword grids. In various embodiments, additional prizes can be awarded when two words are matched using a common letter from the first and second grids, and/or when a word is matched that uses a single letter from a first grid and a separate letter from a second grid along with any intervening letters. In various embodiments of the present invention, a total number of potentially winnable prizes is provided, with a first subset of the potentially winnable prizes associated with the first crossword grid, a second subset of the potentially winnable prizes associated with the second crossword grid, and a third subset of the potentially winnable prizes associated with the first and second crossword grids together. In various embodiments, prizes can be awarded to a subset according to the total number of word matches on an entire ticket, irrespective of total word matches in individual grids. Further, each of the first and second subsets can be greater than one while being less than the total number of potentially winnable prizes. In this way, the present invention communicates that more prizes are available in the game, even if the odds of winning are adjusted such that the payout for any given game in accordance with the present invention is not changed as compared to prior games.

MODES FOR CARRYING OUT THE INVENTION

Figure 1:
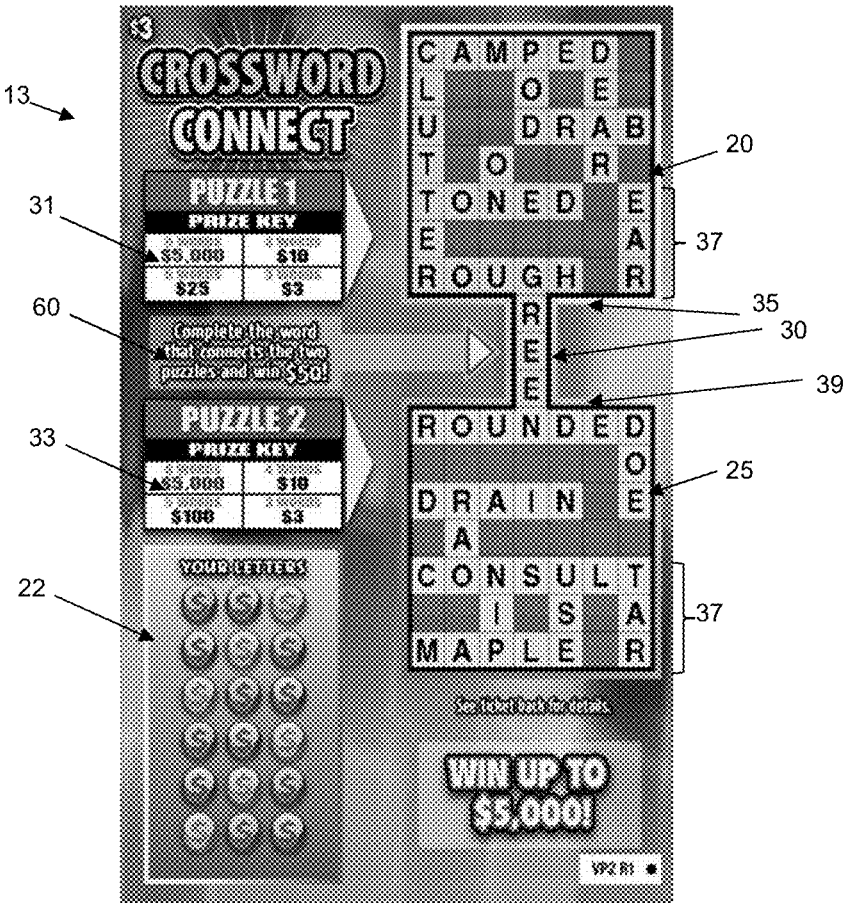
FIGS. 1 and 2 are illustrations of a game ticket in accordance with various embodiments of the present invention, wherein player symbols and winning symbols are revealed, and the grids are connected along an edge.

As shown in FIG. 1, a game ticket 13 is provided with a first crossword grid 20 and a second crossword grid 25. The grids 20, 25 are connected by a single word ("GREEN") 30 arranged vertically and connecting a bottom edge 35 of the first grid 20 with a top edge 39 of the second grid 25. A first prize area 31 indicates the prizes a player can win by matching different numbers of words in the first grid 20 using the player indicia and/or letters from player letter area 22. For example, the player can win $5,000 by matching six words, $25 for matching five words, $10 for matching four words and $3 for matching three words in the first grid 20. A second prize area 33 indicates the prizes a player can win by matching different numbers of words in the second grid 25 using the player indicia and/or letters from player letter area 22. For example, the player can win $5,000 by matching six words, $100 for matching five words, $10 for matching four words and $3 for matching three words in the second grid 25. It will be appreciated that, while the words (e.g., 37) in the first 20 and second 25 grids of FIG. 1 are visible, the ticket 13 in FIG. 1 represents an un-played ticket. The words (e.g., 37) in FIG. 1 are shown in connection with a marking system that allows the words to be viewed underneath a scratch-off area. It will be appreciated that a marking system permits a player to view an indicia prior to removing a layer of typically colored material off of the indicia, after which a different color appears in the background or on the indicia itself, to indicate that the player has already "marked" the associated indicia. Such a marking system is described, for example, in U.S. Patent Application Publication No. 2010/0045026, the disclosure of which is incorporated by reference herein in its entirety. Other marking systems can be employed, including a transparent ticket layer or a translucent ticket layer for example. In various embodiments of the present invention, no scratch-off material is provided and a player can simply mark through letters from the player letter area 22 on the ticket when a letter is matched.

Figure 2:
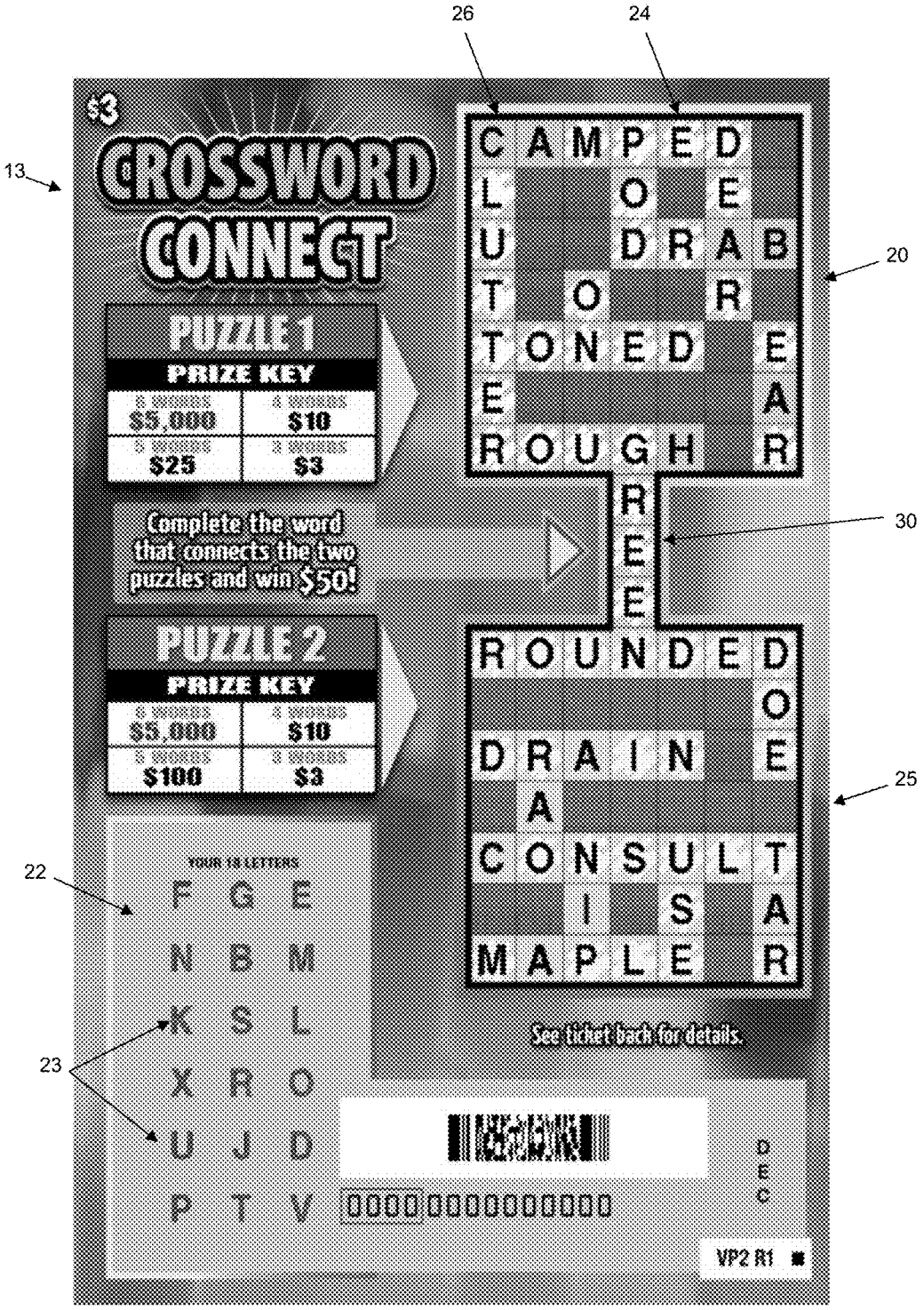

FIG. 2 represents the ticket 13 of FIG. 1, but wherein the scratch-off layer above the player letter area 22 has been removed, revealing individual player letters 23 for play. The first 20 and second 25 grids show letters that have had the scratch-off layer removed (e.g., 24, corresponding to the revealed letters 23), and other letters that have not had the scratch-off layer removed (e.g., 26), because corresponding letters have not been revealed among the player letters 23. In the example of FIG. 2, the ticket shows three matched words ("toned", "on" and "pod") in the first grid 20, and three matched words ("rounded", "doe" and "use") in the second grid 25, although it is possible game play can be conducted such that words that count towards an award must include three or more letters. Thus, the player of ticket 13 would win $3 for the matches in the first grid 20 and $3 for the matches in the second grid 25. Additionally, since the letters 23 include the letters "G", "R", "E" and "N", the player can match the word "GREEN" 30 formed in between the first 20 and second 25 grids. Accordingly, based on the prize label at 60, the player would win an additional $50 for playing this ticket 15. The additional word "GREEN" formed between the two grids provides an added form of excitement, in that it provides an extra word that can be matched, and further provides a single word match resulting in a prize being won, as opposed to the grids 20, 25 which require three or more matched words to earn a prize.

It will be appreciated that the grids 20, 25 can be presented in matrices of different sizes and dimensions, including in a shape other than a square or rectangle. Further, it will be appreciated that the grids can be connected at an area other than a horizontal edge, such as at a corner 95 as shown in ticket 90 of FIG. 3, for example. It will further be appreciated that more than two grids can be provided in various embodiments of the present invention, wherein different numbers of grids can be connected at one or more positions thereon.

The game in various embodiments of the present invention also includes a total number of potentially winnable prizes. As shown in FIGS. 1 and 2, for example, a player can potentially win four different prizes for the first grid 20, four different prizes for the second grid 25 and one prize for the bonus word 30. As such, nine different prizes can be won.

Figure 3:
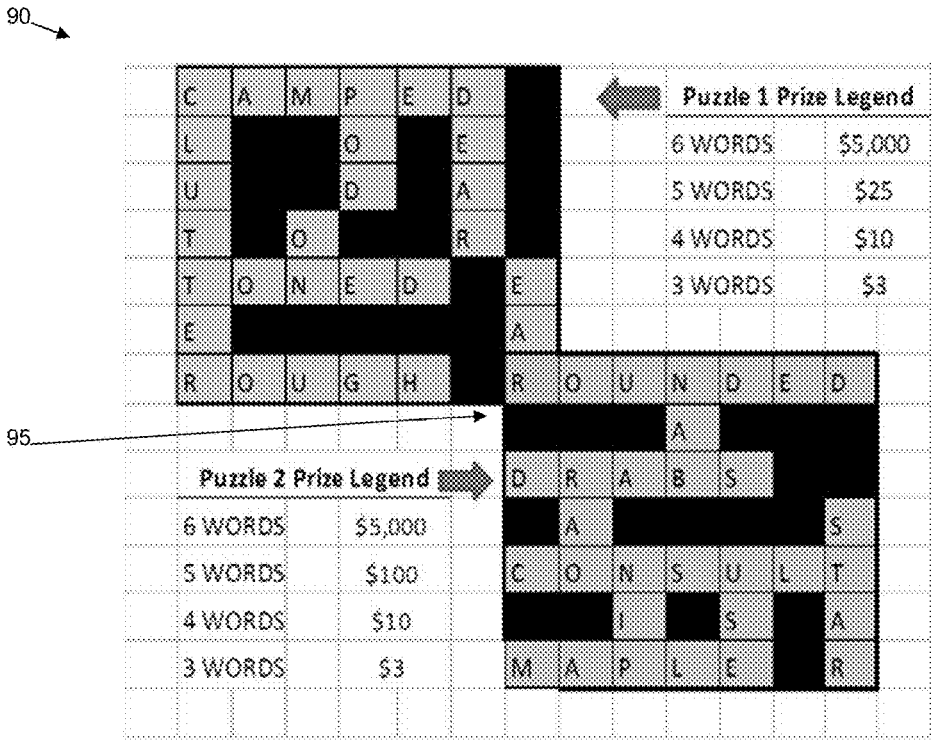
FIG. 3 is an illustration of an alternative game ticket in accordance with different embodiments of the present invention.

It will be appreciated that a lottery game product or system according to aspects of the present invention can thus include a set of physical game tickets, each of which can be represented as a ticket substrate having player indicia and first and second grids applied thereto, such as by printing. Each of the grids has at least one independent indicia combination therein, such as the word "EAR" in grid 20 of FIG. 1, and the word "TAR" in grid 25 of FIG. 1. The word "EAR" combines the individual indicia "E", "A" and "R". The ticket also includes at least one indicia combination that is partially within the first grid and partially within the second grid. In FIGS. 1 and 2, this shared indicia combination is the word "GREEN", including the indicia "G" in the first grid, the indicia "N" in the second grid and the indicia "REE" in between the first and second grids. The indicia "REE" are thus game play elements that are not in either the first or second grids. In FIG. 3, the shared indicia combination includes the words "EAR" and "ROUNDED".

It will further be appreciated that a first subset of the set of physical tickets can include player indicia resulting in one or more indicia combination matches in the first grid only, a second subset that includes player indicia resulting in one or more indicia combination matches in the second grid only, and a third subset having player indicia indicating the ticket is a winner for making a match with the at least one indicia combination that is partially within the first grid and partially within the second grid. Prizes can be awarded in various ways. For example, if a player matches three, four, five or six words in either the first grid or the second grid, appropriate grid-specific prizes may be awarded. Further, if the player matches the adjoining word (e.g., "GREEN" in FIGS. 1 and 2) or the connecting words (e.g., "EAR" and "ROUNDED" in FIG. 3), another prize may be awarded.

Figure 4:
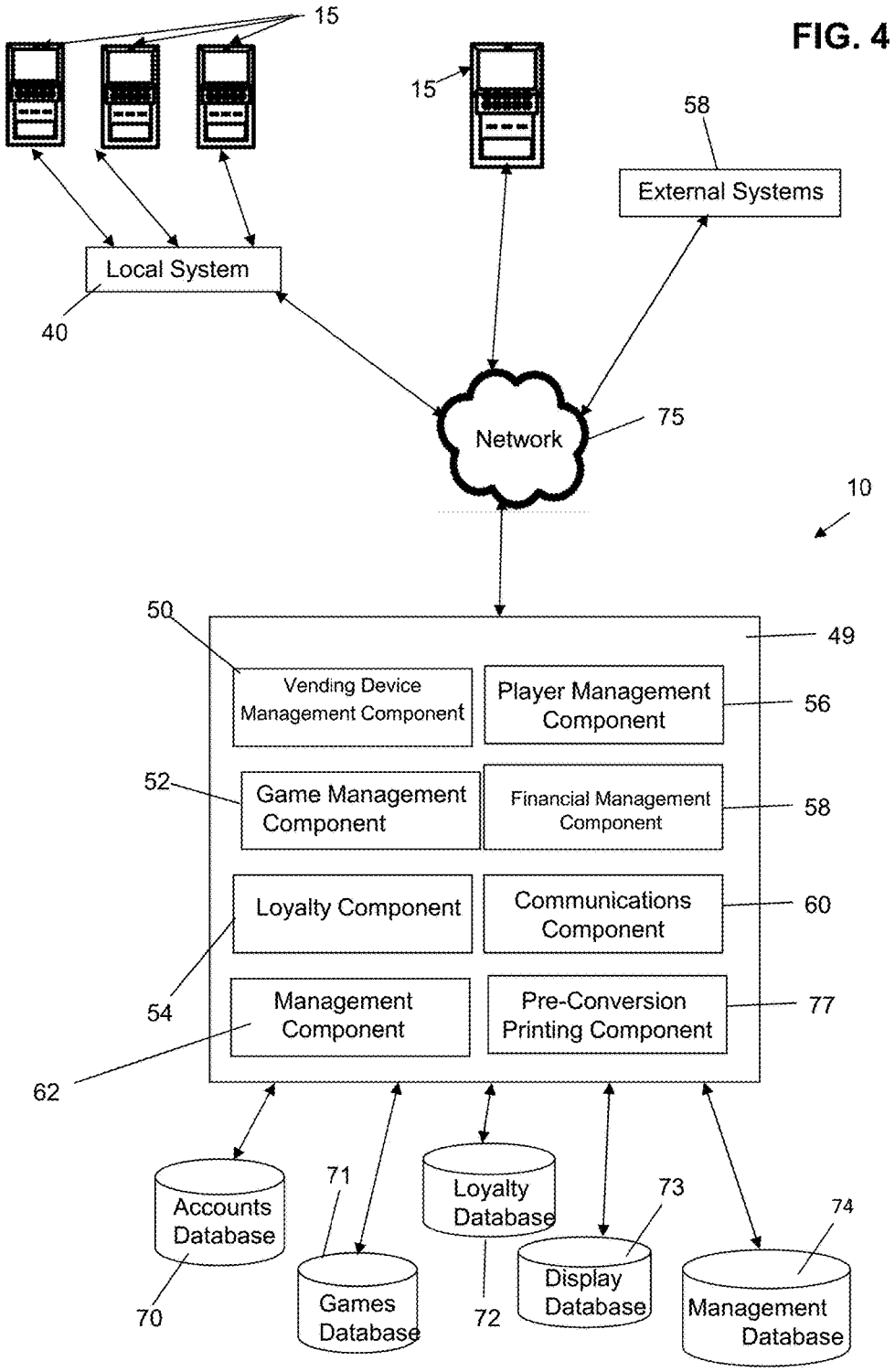
FIG. 4 is a schematic diagram illustrating a system interacting with vending and/or display devices in accordance with embodiments of the present invention.

The tickets 13, 90 of the lottery game system and method according to the present invention can be printed physical tickets, or can also be electronic tickets that are played using any of various electronic devices, including mobile communications devices (e.g., smart phones), personal computing devices (e.g., desktops, laptops), stand-alone video lottery terminals, retailer terminals and other known devices, for example, as represented by 15 in FIG. 4. In one embodiment of the present invention, electronic tickets can be presented to the user of an electronic device over a network that is connected to a host computer that creates, issues, validates and/or redeems tickets using suitable programming stored in a memory thereof and operable via a computer processor maintained within the host. The player's electronic device also includes suitable programming, memory and processing capability to facilitate electronic representation of the game of the present invention on a display associated with the electronic device. Additionally, the crossword-based game product of the present invention can be provided as a primary ticket game product, or as a bonus or second chance game product. For instance, a player may play a different lottery ticket as a base game, and then play the game disclosed herein as a bonus or second chance game. The additional game can be played as a physical ticket or electronically. In various embodiments, a base ticket game can be played and a code can be provided for use with an online game made available over a network such as the Internet, for example. Once the player enters the code from the ticket into a suitable interface (such as a mobile communications device, personal computing device, etc.), the game of the present invention can be provided for play.

In another aspect of the present invention, a method of providing a lottery game system and product is provided. The method includes providing a ticket having potentially winnable prizes via a crossword-based game according to the various embodiments shown and described herein.

As noted above, the game system can employ physical tickets, or virtual tickets accessible via a computing device, including mobile devices. A ticket can be obtained at a retail location from a clerk operating a point-of-sale device or from a self-service kiosk, for example. A ticket can also be obtained through a website, through a mobile application, and through other physical and virtual locations. Any device 15 operable to display, construct or print a ticket according to the present invention can be referred to as a vending device herein.

In various embodiments, the present invention can operate with one or more vending units 15 in networked connection with a remote central host computer system 49, as shown in FIG. 4 and described elsewhere herein. The central host computer system 49 can provide instructions to the one or more vending devices 15 as these devices carry out their designed functions. As shown in FIG. 4, it will be appreciated that system 10 can be deployed with direct connections from central host 49 to a vending device 15 via network 75, or through an indirect connection through a local computing system 40. As further shown in FIG. 4, the central host 49 can be provided with various components such as, for example, device management component 50, game management component 52, loyalty component 54, player management component 56, financial management component 58, communications component 60, general management component 62 and randomizer component 77. These components can access and employ various databases for storing and retrieving data in accordance with the desired functions of the present invention. Databases can include, for example, an accounts database 70, a game database 71, a loyalty database 72, a display database 73 and a management database 74.

The accounts database 70 can store information related to user accounts, including user identification details, user transaction history, user preferences, user financial information and account details and other information. The game database 71 can store information pertaining to available games for selection, including graphic designs, grids, words, relationship links for grids, available wager amounts, odds and other game-related elements. Loyalty database 72 can store various loyalty-related data, including redemption prizes, qualifying levels and other loyalty items. The display database 73 can store a library of displays (e.g., 13) to be presented on the device interfaces, including player selection options (for touch-screen selection) as well as visual outcome displays or animations employed during inactive periods or for entertainment during player use. Management database 74 can store information such as device-specific statistics to permit lottery service providers and retailers to better understand device usage, including game-related statistics, ticket volumes, retailer statistics and other information that can assist in better servicing players, increasing revenue and overall management of devices.

The specific components can comprise software or hardware, incorporating computer-readable instructions stored in suitable memory and operable by one or more processors to perform the functions necessary for operation of the embodiments of the present invention. For instance, the device management component 50 operates to receive instructions from the vending devices 15, process the desired transactions and requests, and deliver instructions to the vending devices 15 for printing, displaying and/or otherwise executing the desired device functions. The game management component 52 operates to process specific game-related instructions such as, for example, selecting desired game details from the game database 71, configuring the details according to player requests and game rules, and delivering the details to the vending device 15 for printing, display and/or other operations. The loyalty component 54 operates to process loyalty-related transactions as appropriate based on player interaction, including adding to or subtracting from a loyalty points total, redeeming loyalty points and issuing prizes as appropriate. The user management component 56 processes user-related details, including user transaction requests, and updates the accounts database 70 accordingly. The financial management component 58 operates to process financial transactions initiated at the vending devices 15, including communicating with accounts database 70 and any other external providers 58, such as financial institutions, for example. The communications component 60 operates to communicate with the vending devices 15 and external providers 58 over network 75 to perform functions in accordance with the embodiments of the present invention. The management component 62 processes management-related information, such as usage statistics and control information, to and from management database 74. Such information can be employed by external systems 58 such as an external management operator, or by local systems, such as system 40, which can be a retailer operation controlling multiple devices 15 as shown in FIG. 4, for example. The randomizer component 77 operates to randomly select grids and/or words from the games database 71 in order to populate multiple grids on each user's ticket.

In various embodiments, the games database 71 can be initially populated with various crossword grids and relationship compatibility links, including a first set of grids that have a corner connector compatibility link with a second set of grids and an edge connector compatibility link with a third set of grids. Alternatively, the games database 71 can be populated with specific words that are injectable into incomplete crossword grids depending upon whether the multiple grids are connected at corners or on edges.

In operation, a user may be presented with a game selection display from which to choose a game in which to wager on for a wagering game associated with the present invention. The selection display may be presented, for example, on a display of the user's computing device 15, on a display of a self-service operated kiosk vending device 15, or on a display of a retailer-operated vending device 15, wherein the user selects the game by communicating with a sales clerk operating the device 15, for example. With reference to FIG. 4, and depending upon the implementation, a wager request may be received at a vending device 15 and then transferred to the central host 49. Payment can be handled at the device through via cash, bank card account and/or player account, for example. The wager request can further include the selection of a desired game, ticket design, wager level, prize structure or other selection. Once the payment and ticket/ticket selection have been received by the device 15, the player inputs are transmitted to the central host 49 for processing and storing, or a subset of player inputs are transmitted.

In response to a user selecting a specific game, for example, the host 49 operates randomizer component 77 to randomly select multiple independent crossword grids to be connected corresponding to the selected game (e.g., with connected corners, or connected edges). The randomizer component 77 can also select and/or generate game play elements that are not in either the first or second grids and that are not player indicia, such as indicia "REE" in FIGS. 1 and 2 that adjoin the first 20 and second 25 grids but are not in either grid.

It will be appreciated that, in various embodiments and using FIGS. 1 and 2 as an example, tickets are generated by (1) randomly generating the first 20 and second grid 25 formations, such as two seven-by-seven grids with a three-by-one connection between the grids; (2) randomly generating the layout of spaces to be filled by letters, and spaces to be rendered blank and/or blacked out; (3) randomly generating the words to fill the empty positions, including connection words for connecting grids 20 and 25; and (4) randomly selecting a set of "Your Letters" to create the desired prize level(s). When these steps are completed, a single ticket is created, and these steps are repeated as many times as necessary in order to create all of the pools and/or subsets of tickets for a given game. A similar process can be employed in connection with the ticket type represented in FIG. 3.

In the above process, it will be appreciated that the remote server randomly generates the word combinations in the first grid, the word combinations in the second grid, and the indicia combination that is partially within the first grid and partially within the second grid. In the embodiments as shown in FIGS. 1 and 2, the remote server further generates the letters and/or indicia elements that are not in either of the first or second grids. These letters ("REE") in FIGS. 1 and 2 are not player indicia, which are separately depicted at 22.

The user can be issued a ticket by having a physical ticket printed by or through use of the vending device 15. Alternatively, a virtual ticket can be displayed on such devices 15 and optionally printed thereafter as desired by the user. The issued ticket displays the multiple connected crossword grids. Winnings can be awarded in a number of ways. For example, winnings can be awarded based on the number of words matched in each or both puzzles, whether a connector word or words are matched and other bases.

It will be appreciated that all of the disclosed methods and procedures herein can be implemented using one or more computer programs or components. These components may be provided as a series of computer instructions on any conventional computer-readable medium, including non-transitory computer-readable media, RAM, SATA DOM or other storage media. The instructions may be configured to be executed by a processor which, when executing the series of computer instructions, performs or facilitates the performance of all or part of the disclosed methods and procedures. The present invention can be implemented using hardware, software, or a combination thereof, and can be implemented in one or more computer systems or other processing systems. In various embodiments, the invention is directed toward one or more computer systems capable of carrying out the functionality described herein.

Unless otherwise stated, devices or components of the present invention that are in communication with each other do not need to be in continuous communication with each other. Further, devices or components in communication with other devices or components can communicate directly or indirectly through one or more intermediate devices, components or other intermediaries. Further, descriptions of embodiments of the present invention herein wherein several devices and/or components are described as being in communication with one another does not imply that all such components are required, or that each of the disclosed components must communicate with every other component. In addition, while algorithms, process steps and/or method steps may be described in a sequential order, such approaches can be configured to work in different orders. In other words, any ordering of steps described herein does not, standing alone, dictate that the steps be performed in that order. The steps associated with methods and/or processes as described herein can be performed in any order practical. Additionally, some steps can be performed simultaneously or substantially simultaneously despite being described or implied as occurring non-simultaneously.

It will be appreciated that algorithms, method steps and process steps described herein can be implemented by appropriately programmed general purpose computers and computing devices, for example. In this regard, a processor (e.g., a microprocessor or controller device) receives instructions from a memory or like storage device that contains and/or stores the instructions, and the processor executes those instructions, thereby performing a process defined by those instructions. Further, programs that implement such methods and algorithms can be stored and transmitted using a variety of known media. At a minimum, the memory includes at least one set of instructions that is either permanently or temporarily stored. The processor executes the instructions that are stored in order to process data. The set of instructions can include various instructions that perform a particular task or tasks. Such a set of instructions for performing a particular task can be characterized as a program, software program, software, engine, module, component, mechanism, or tool. Common forms of computer-readable media that may be used in the performance of the present invention include, but are not limited to, RAM, USB drive or any other memory chip or cartridge, or any other medium from which a computer can read. The term "computer-readable medium" when used in the present disclosure can refer to any medium that participates in providing data (e.g., instructions) that may be read by a computer, a processor or a like device. Such a medium can exist in many forms, including, for example, non-volatile media, volatile media, and transmission media. Non-volatile media include, for example, USB and other persistent memory. Volatile media can include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications.

Various forms of computer readable media may be involved in carrying sequences of instructions associated with the present invention to a processor. For example, sequences of instruction can be delivered from RAM to a processor, carried over a wireless transmission medium, and/or formatted according to numerous formats, standards or protocols, such as Transmission Control Protocol/Internet Protocol (TCP/IP), Wi-Fi, Bluetooth, GSM, CDMA, EDGE and EVDO. Where databases are described in the present disclosure, it will be appreciated that alternative database structures to those described, as well as other memory structures besides databases may be readily employed. The drawing figure representations and accompanying descriptions of any exemplary databases presented herein are illustrative and not restrictive arrangements for stored representations of data. Further, any exemplary entries of tables and parameter data represent example information only, and, despite any depiction of the databases as tables, other formats (including relational databases, object-based models and/or distributed databases) can be used to store, process and otherwise manipulate the data types described herein. Electronic storage can be local or remote storage, as will be understood to those skilled in the art. Appropriate encryption and other security methodologies can also be employed by the system of the present invention, as will be understood to one of ordinary skill in the art.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A system for use by lottery game players, the system comprising:

a set of physical game tickets for playing a first game, wherein each physical game ticket of the set of physical game tickets includes a substrate having printed thereon, in one or more areas, one or more player indicia and first and second grids, each of the grids containing at least one independent indicia combination therein, the substrate further including at least one indicia combination partially within the first grid and partially within the second grid;

a first subset of the game tickets having player indicia that indicates the ticket is a winner of a first prize for matching the player indicia to the at least one indicia combination in the first grid;

a second subset of the game tickets having player indicia that indicates the ticket is a winner of a second prize for matching the player indicia to the at least one indicia combination in the second grid; and a third subset of the game tickets having player indicia that indicates the ticket is a winner of a third prize for matching the player indicia to the at least one indicia combination that is partially within the first grid and partially within the second grid.

2. The system of claim 1, wherein the at least one indicia combination partially within the first and second grids includes multiple words.

3. The system of claim 1, wherein the at least one indicia combination partially within the first and second grids is a word having a first letter in the first grid and a second letter in the second grid.

4. The system of claim 3, wherein the word includes at least one additional letter between the first and second letters that are not within the first grid or the second grid.

5. The system of claim 1, further including a remote server operable to randomly generate the first and second grids.

6. The system of claim 5, wherein the remote server randomly generates the at least one independent indicia combination in the first grid, the at least one independent indicia combination in the second grid, and the at least one indicia combination that is partially within the first grid and partially within the second grid.

7. The system of claim 5, wherein the remote server generates at least one game play element that is not in either the first or second grids and that is not player indicia.

8. A system for facilitating the operation of a game of chance, comprising:

a host having at least one processor for executing a plurality of instructions stored in at least one memory device to:

receive a request from a computing device for a virtual game ticket;

issue a virtual game ticket to a computing device, the virtual game ticket including game play information in the form of one or more player indicia thereon, the virtual game ticket further including first and second grids thereon, with each of the grids including at least one independent indicia combination therein, the virtual game ticket further including at least one indicia combination partially within the first grid and partially within the second grid;

a total number of potentially winnable prizes, each of the potentially winnable prizes capable of being won by matching the player indicia with at least one of the indicia combination in the first or second grid;

a first number of potentially winnable prizes capable of being won by matching the player indicia with the at least one indicia combination in the first grid;

a second number of potentially winnable prizes capable of being won by matching the player indicia with the at least one indicia combination in the second grid; and a third number of potentially winnable prizes capable of being won by matching the player indicia with the at least one indicia combination that is partially within the first grid and partially within the second grid.

9. The system of claim 8, wherein the at least one indicia combination partially within the first and second grids includes multiple words.

10. The system of claim 8, wherein the at least one indicia combination partially within the first and second grids is a word having a first letter in the first grid and a second letter in the second grid.

11. The system of claim 8, wherein the word includes at least one additional letter between the first and second letters that are not within the first grid or the second grid.

12. The system of claim 8, further including a remote server operable to randomly generate the first and second grids.

13. The system of claim 12, wherein the remote server generates at least one game play element that is not in either the first or second grids and that is not player indicia.

14. A method for operating a gaming system, comprising:

providing a user interface on a computing device for access by a player;

displaying a virtual game ticket to the computing device, the virtual game ticket including game play information in the form of one or more player indicia thereon, the virtual game ticket further including first and second grids thereon, with each of the grids including at least one independent indicia combination therein, the virtual game ticket further including at least one indicia combination partially within the first grid and partially within the second grid, and at least one game play element that is not in either the first or second grids and that is not player indicia;

a total number of potentially winnable prizes, each of the potentially winnable prizes capable of being won by matching the player indicia with at least one of the indicia combination in the first or second grid;

a first number of potentially winnable prizes capable of being won by matching the player indicia with the at least one indicia combination in the first grid;

a second number of potentially winnable prizes capable of being won by matching the player indicia with the at least one indicia combination in the second grid; and a third number of potentially winnable prizes capable of being won by matching the player indicia with the at least one indicia combination that is partially within the first grid and partially within the second grid.

15. A lottery game product, comprising:

a substrate bearing one or more player indicia and first and second grids, each of the grids containing at least one independent indicia combination therein, the substrate further including at least one indicia combination partially within the first grid and partially within the second grid;

a total number of potentially winnable prizes, each of the potentially winnable prizes capable of being won by matching the player indicia with at least one of the indicia combination in the first or second grid;

a first number of potentially winnable prizes capable of being won by matching the player indicia with the at least one indicia combination in the first grid;

a second number of potentially winnable prizes capable of being won by matching the player indicia with the at least one indicia combination in the second grid; and a third number of potentially winnable prizes capable of being won by matching the player indicia with the at least one indicia combination that is partially within the first grid and partially within the second grid.

16. The lottery game product of claim 15, wherein the at least one indicia combination partially within the first and second grids includes multiple words.

17. The lottery game product of claim 15, wherein the at least one indicia combination partially within the first and second grids is a word having a first letter in the first grid and a second letter in the second grid.

18. The lottery game product of claim 17, wherein the word includes at least one additional letter between the first and second letters that are not within the first grid or the second grid.

19. The lottery game product of claim 15, further including a remote server operable to randomly generate the first and second grids.

20. The lottery game product of claim 19, wherein the remote server randomly generates the at least one independent indicia combination in the first grid, the at least one independent indicia combination in the second grid, and the at least one indicia combination that is partially within the first grid and partially within the second grid.

* * * * *